US012571572B2

(12) United States Patent
Foster et al.

(10) Patent No.: US 12,571,572 B2
(45) Date of Patent: Mar. 10, 2026

(54) DRAINLESS ICE MAKING APPLIANCE WITH GRAVITY FILTER

(71) Applicant: Haier US Appliance Solutions, Inc., Wilmington, DE (US)

(72) Inventors: Ronald Gary Foster, Louisville, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 119 days.

(21) Appl. No.: 18/447,185

(22) Filed: Aug. 9, 2023

(65) Prior Publication Data

US 2025/0052467 A1 Feb. 13, 2025

(51) Int. Cl.
*F25C 1/045* (2018.01)
*F25C 1/18* (2006.01)
(Continued)

(52) U.S. Cl.
CPC ..... *F25C 1/045* (2013.01); *F25C 1/18* (2013.01); *F25C 1/24* (2013.01); *F25C 1/25* (2018.01);
(Continued)

(58) Field of Classification Search
CPC .... F25C 1/045; F25C 1/18; F25C 1/24; F25C 1/25; F25C 5/182; F25C 2301/00;
(Continued)

(56) References Cited

U.S. PATENT DOCUMENTS 4,370,865 A * 2/1983 Hibino ..... F25C 1/12 62/347
4,959,966 A * 10/1990 Dimijian ..... F25C 1/045 62/347
(Continued)

FOREIGN PATENT DOCUMENTS

CN 210161939 U * 3/2020
CN 111442602 A 7/2020
(Continued)

OTHER PUBLICATIONS

CN-112499859-A, machine translation (Year: 2025).*
(Continued)

*Primary Examiner* — Len Tran
*Assistant Examiner* — Kirstin U Oswald
(74) *Attorney, Agent, or Firm* — Dority & Manning, P.A.

(57) ABSTRACT

An ice making appliance defines a vertical direction, a lateral direction, and a transverse direction. The ice making appliance includes a cabinet, an ice storage compartment, an ice mold provided above the ice storage compartment, a first reservoir provided within the cabinet, a deionization filter provided within the first reservoir, a conductivity sensor coupled to the deionization filter, and a first circulation system is provided in the first reservoir. The first circulation system includes an inlet downstream of the deionization filter whereby the first circulation system supplies filtered water to the ice mold. A second reservoir is provided within the cabinet, and the second reservoir in fluid communication with the first reservoir.

12 Claims, 5 Drawing Sheets

(51) Int. Cl.
*F25C 1/24* (2018.01)
*F25C 1/25* (2018.01)
*F25C 5/182* (2018.01)

(52) U.S. Cl.
CPC ..... *F25C 5/182* (2013.01); *F25C 2301/00* (2013.01); *F25C 2400/04* (2013.01); *F25C 2400/10* (2013.01); *F25C 2700/00* (2013.01)

(58) Field of Classification Search
CPC ..... F25C 2400/04; F25C 2400/10; F25C 2700/00; F25C 2400/12; C02F 1/003; C02F 2301/043; C02F 1/008; C02F 2201/004; C02F 2209/005; C02F 2209/05; C02F 2209/42; C02F 2307/12
USPC ..... 62/340
See application file for complete search history.

(56) References Cited

U.S. PATENT DOCUMENTS

| | | | | |
|---|---|---|---|---|
| 4,970,877 | A * | 11/1990 | Dimijian | F25C 1/12 62/344 |
| 5,024,764 | A * | 6/1991 | Holler | B01J 47/012 264/112 |
| 9,620,996 | B2 | 4/2017 | Zeine et al. | |
| 9,719,711 | B2 | 8/2017 | Bortoletto | |
| 9,839,868 | B2 | 12/2017 | Fritze | |
| 10,274,238 | B2 | 4/2019 | Mitchell | |
| 10,406,461 | B2 | 9/2019 | Subrahmanya et al. | |
| 10,450,203 | B2 | 10/2019 | Schuster | |
| 10,786,768 | B2 | 9/2020 | Fritze | |
| 10,843,107 | B2 | 11/2020 | Bippus et al. | |
| 10,946,319 | B2 | 3/2021 | Bippus et al. | |
| 11,025,447 | B2 | 6/2021 | Ebrom et al. | |
| 11,460,232 | B2 | 10/2022 | Mitchell et al. | |
| 11,654,383 | B2 | 5/2023 | Mitchel et al. | |
| 2006/0011523 | A1 | 1/2006 | Schrott et al. | |
| 2012/0048804 | A1* | 3/2012 | Stetson | B01D 67/006 210/252 |
| 2014/0305471 | A1* | 10/2014 | Kashkoush | H01L 21/67051 134/109 |
| 2016/0075566 | A1 | 3/2016 | Froelicher | |
| 2018/0017304 | A1* | 1/2018 | Knatt | F25C 5/04 |
| 2018/0128530 | A1* | 5/2018 | Mitchell | F25D 23/126 |
| 2018/0372388 | A1* | 12/2018 | Mitchell | C02F 1/008 |
| 2020/0224949 | A1* | 7/2020 | Kandi | F25C 5/22 |
| 2021/0077927 | A1 | 3/2021 | Fritze | |
| 2021/0247121 | A1* | 8/2021 | Olson, Jr. | F25B 5/02 |
| 2022/0034570 | A1* | 2/2022 | Lee | F25C 1/045 |
| 2022/0154989 | A1 | 5/2022 | Kim et al. | |
| 2023/0003431 | A1 | 1/2023 | Junge et al. | |

FOREIGN PATENT DOCUMENTS

| | | | | |
|---|---|---|---|---|
| CN | 112499859 | A * | 3/2021 | C02F 1/001 |
| EP | 3242376 | B1 | 8/2019 | |
| JP | H0777371 | A * | 3/1995 | F25C 1/04 |
| JP | 2005302513 | A * | 10/2005 | |
| JP | 2012223753 | A | 11/2012 | |
| KR | 20100082190 | A * | 7/2010 | F25C 5/182 |
| KR | 101566282 | B1 | 11/2015 | |

OTHER PUBLICATIONS

JP-2005302513-A, machine translation (Year: 2025).*
KR-20100082190-A, machine translation (Year: 2025).*
CN-210161939-U, machine translation (Year: 2025).*
JPH 0777371 A machine translation (Year: 2025).*

* cited by examiner

DRAINLESS ICE MAKING APPLIANCE WITH GRAVITY FILTER

FIELD OF THE INVENTION

The present subject matter relates generally to ice making appliances, and more particularly to stand alone ice making appliances that are configured to produce ice.

BACKGROUND OF THE INVENTION

Ice making appliances generally include an ice maker that is configured to generate ice. Ice makers within ice making appliances are plumbed to a water supply, and water from the water supply may flow to the ice maker within the ice making appliances. Ice making appliances are frequently cooled by a sealed system, and heat transfer between liquid water in the ice maker and refrigerant of the sealed system generates ice.

In certain ice making appliances, for instance, clear ice makers, water may be continually sprayed onto a chilled mold to form ice without dissolved solids which result in cloudy ice. Commonly, the ice making appliances are plumbed to an external drain (e.g., connected to a municipal water system) to dispose of the excess water that is not frozen during an icemaking process (e.g., excess water containing dissolved solids). While effective for managing excess water, external drain lines have drawbacks. For example, external drain lines can be expensive to install. In addition, external drain lines can be difficult to install in certain locations. Additionally, cleaning such ice making appliances can be burdensome and time consuming.

Further, certain ice making appliances utilize potable municipal water in an icemaking process. This municipal water contains certain levels of Total Dissolved Solids (TDS). During some icemaking processes, only the water containing sufficiently low levels of TDS will freeze into clear ice cubes. The leftover water then contains a higher concentration of TDS, which is too high to form clear ice. In order to reduce the amount of dissolved solids in the water, the water may be filtered, e.g., the appliance may include a filter. After a period of use, such filters become fouled and may thus be cleaned or replaced. The particular period after which a filter becomes fouled may vary, e.g., based on the quality of the water used to make ice, however, filters are typically replaced on a predetermined schedule, such as a three-month schedule where every three months the filter is replaced, or after a certain amount of water has been passed through the filter. As such, water filters can often be unnecessarily replaced too early.

Accordingly, a device for filtering water for the manufacture of ice that is not replaced based on time or water usage would be desirable. More particularly, a device for filtering water and removing dissolved solids in an appliance for manufacturing clear ice that is not replaced based on time or water usage would be particularly useful.

BRIEF DESCRIPTION OF THE INVENTION

Aspects and advantages of the invention will be set forth in part in the following description, or may be obvious from the description, or may be learned through practice of the invention.

In one example, an ice making appliance defines a vertical direction, a lateral direction, and a transverse direction. The ice making appliance includes a cabinet, an ice storage compartment, an ice mold provided above the ice storage compartment, a first reservoir provided within the cabinet, a deionization filter provided within the first reservoir, a conductivity sensor coupled to the deionization filter, and a first circulation system is provided in the first reservoir. The first circulation system includes an inlet downstream of the deionization filter whereby the first circulation system supplies filtered water to the ice mold. A second reservoir is provided within the cabinet, and the second reservoir in fluid communication with the first reservoir.

According to another example aspect of the present disclosure, an ice making appliance includes a cabinet, an ice storage compartment, a first reservoir provided within cabinet, an ice maker provided within the first reservoir to dispense ice into the ice storage compartment, and a circulation system arranged within the cabinet. The circulation system includes a first circulation conduit, a first pump connected to the first circulation conduit to pump liquid through the first circulation conduit, and a nozzle downstream from the first circulation conduit to dispense the liquid from the first circulation conduit. A second reservoir is provided within the cabinet. The second reservoir is in fluid communication with the first reservoir. A meltwater conduit is connected to the ice storage compartment to direct melt water from the ice storage compartment to the second reservoir. The circulation system also includes a second circulation conduit, and a second pump provided in the cabinet to pump meltwater through the second circulation conduit to the first reservoir. A deionization filter is provided within the first reservoir, and a conductivity sensor is coupled to the deionization filter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
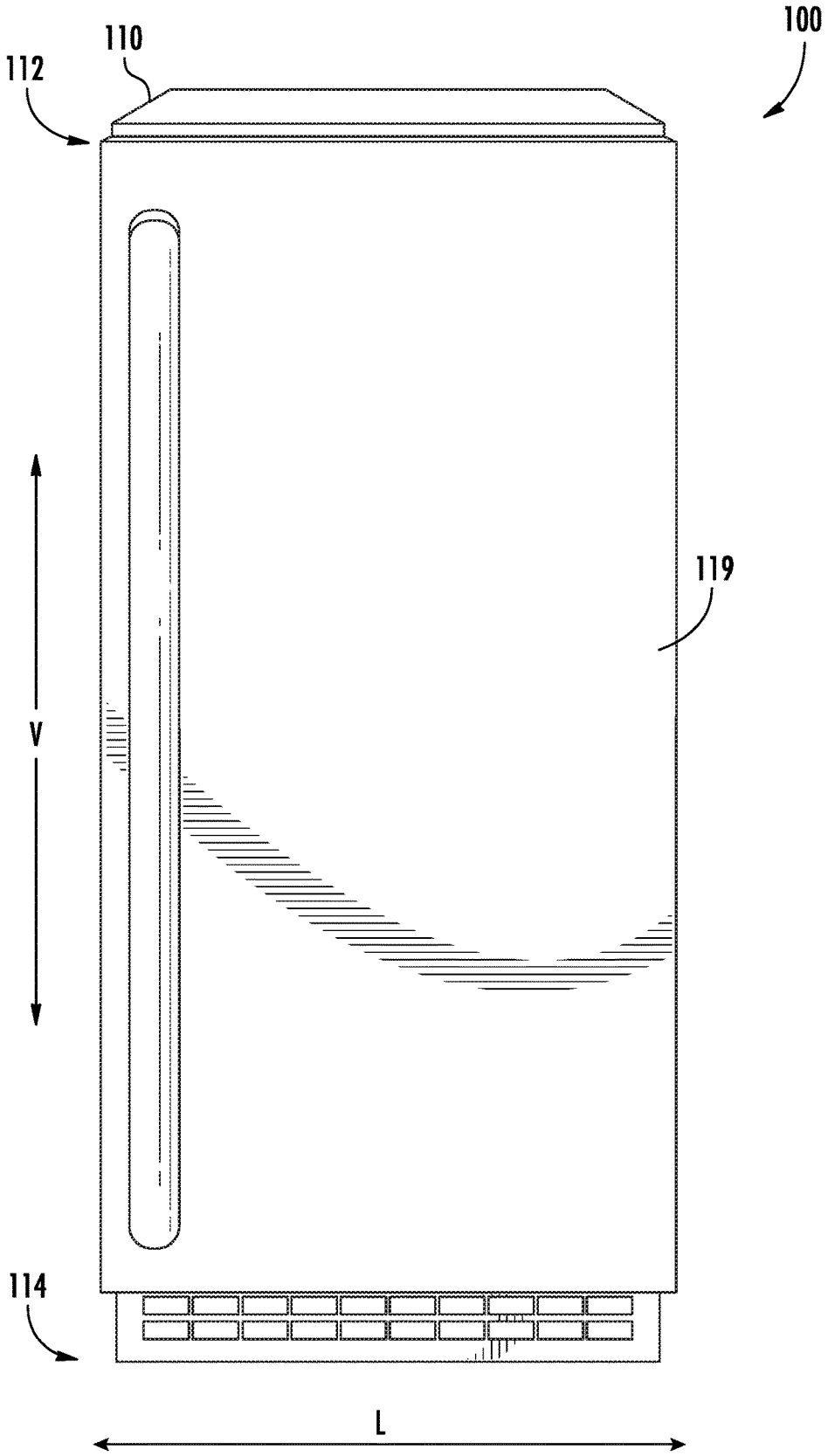
FIG. 1 provides a front, perspective view of an ice making appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
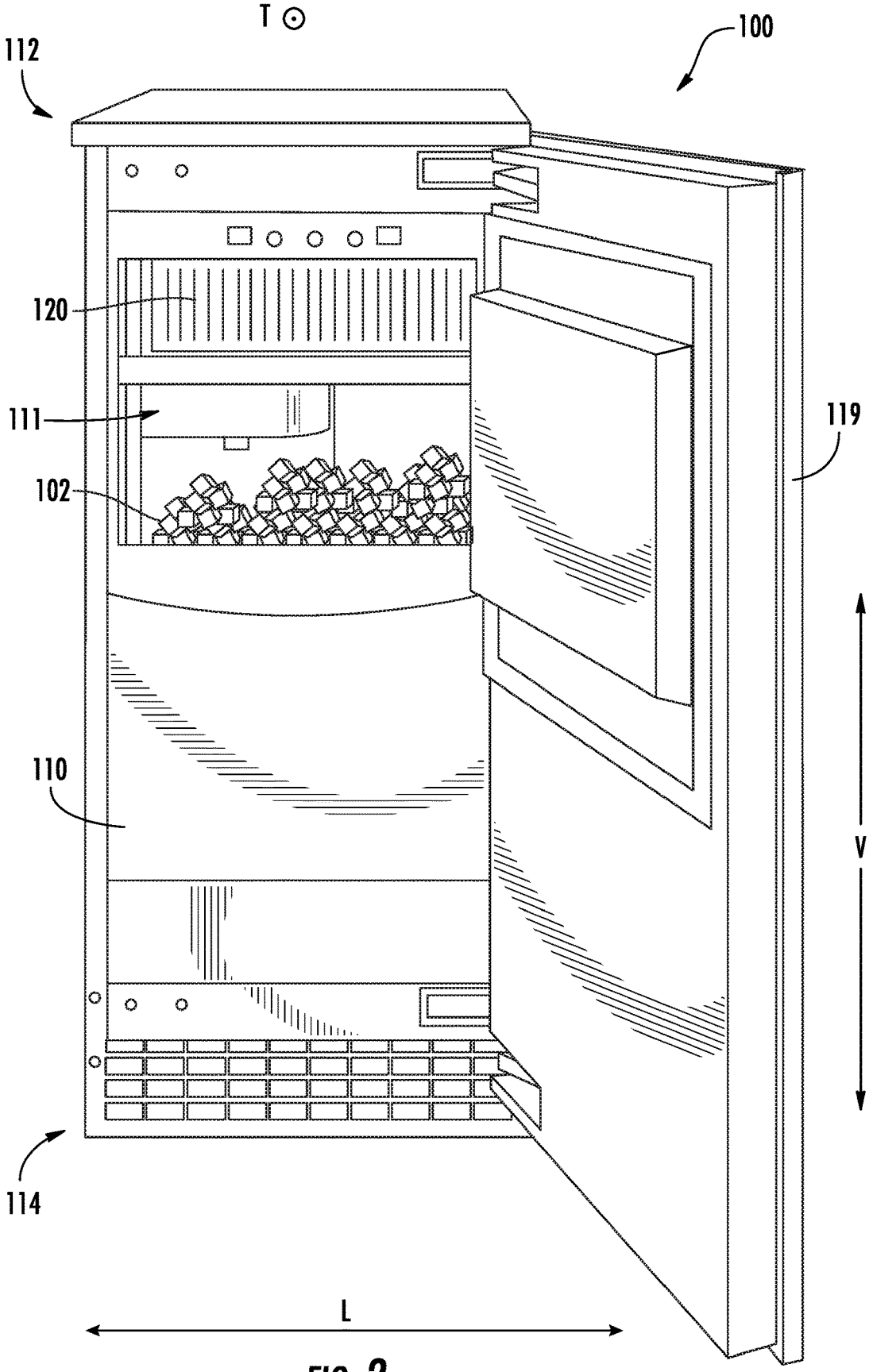
FIG. 2 provides a front, perspective view of the example ice making appliance of FIG. 1 with a door of the ice making appliance shown in an open position.

FIGS. 1 and 2 provide front, perspective views of a drainless ice making appliance 100 according to an example embodiment of the present subject matter. As discussed in greater detail below, ice making appliance 100 includes features for generating or producing clear ice. Thus, a user of ice making appliance 100 may consume clear ice stored within ice making appliance 100. As may be seen in FIG. 1, ice making appliance 100 generally defines a vertical direction V, a lateral direction L, and a transverse direction T, each of which is mutually perpendicular, such that an orthogonal coordinate system is generally defined. Transverse direction T as illustrated would be understood as going either into or out of the page. The transverse direction T may be better seen in FIG. 3.

Ice making appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V. Thus, top and bottom portions 112, 114 of cabinet 110 are spaced apart from each other, e.g., along the vertical direction V. A door 119 is mounted to cabinet 110 at a front portion of cabinet 110. Door 119 permits selective access to interior volume 111 of cabinet 110. For example, door 119 is shown in a closed position in FIG. 1, and door 119 is shown in an open position in FIG. 2. A user may rotate door 119 between the open and closed positions to access interior volume 111 of cabinet 110.

As may be seen in FIG. 2, various components of ice making appliance 100 are positioned within interior volume 111 of cabinet 110. In particular, ice making appliance 100 includes an ice maker 120 disposed within interior volume 111 of cabinet 110, e.g., at top portion 112 of cabinet 110. Ice maker 120 is configured for producing clear ice. Ice maker 120 may be configured for making any suitable type of clear ice. Thus, e.g., ice maker 120 may be a clear cube ice maker, as would be understood.

Ice making appliance 100 may also include an ice storage compartment or storage bin 102. Ice storage compartment 102 may be provided within interior volume 111 of cabinet 110. In particular, ice storage compartment 102 may be positioned, e.g., directly, below ice maker 120 along the vertical direction V. Thus, ice storage compartment 102 is positioned for receiving clear ice from ice maker 120 and is configured for storing the clear ice therein. It will be understood that ice storage compartment 102 may be maintained at a temperature greater than the freezing point of water. Thus, the clear ice within ice storage compartment 102 may melt over time while stored within ice storage compartment 102. Ice making appliance 100 may include features for recirculating liquid meltwater from ice storage compartment 102 to ice maker 120.

Figure 3:
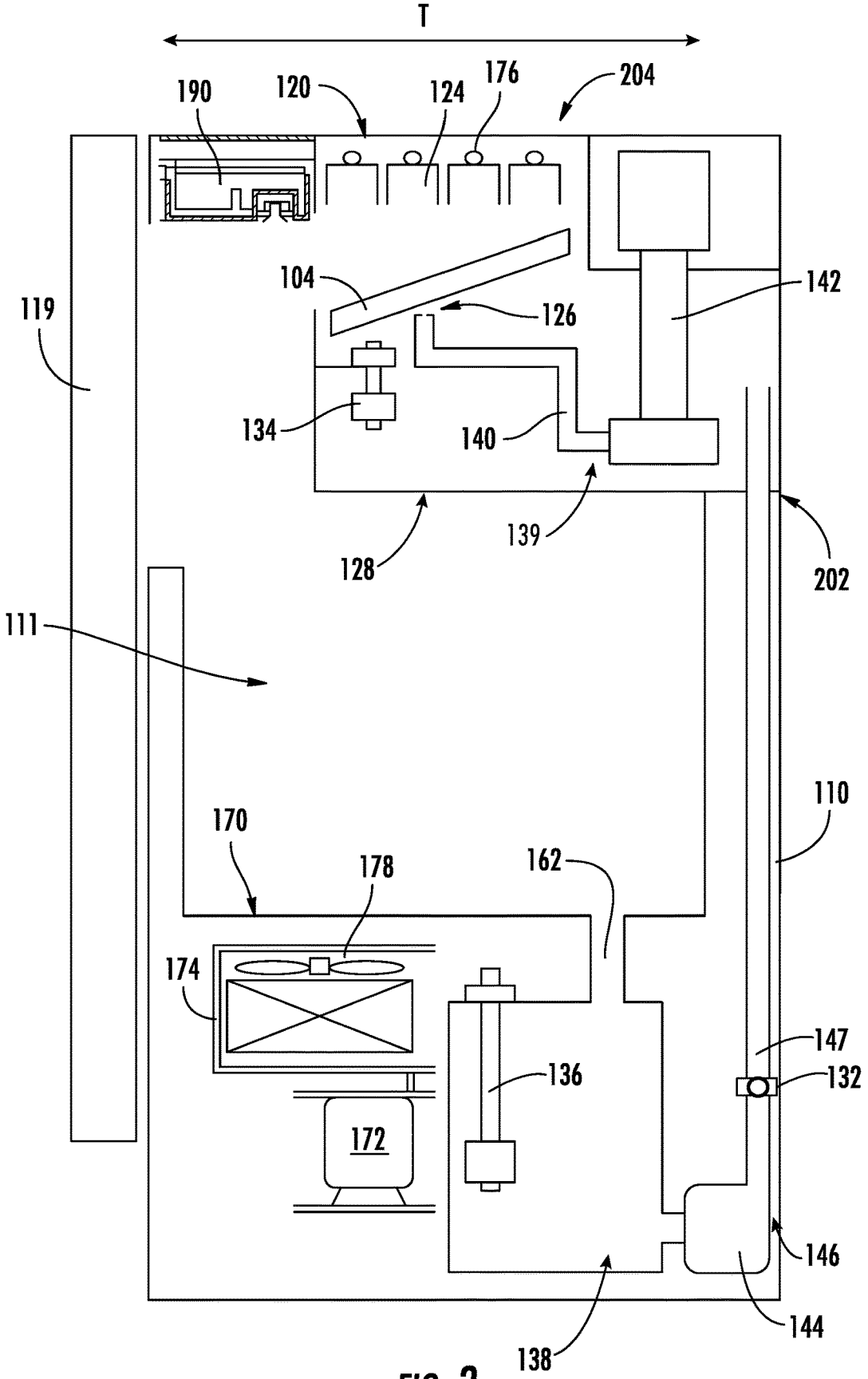
FIG. 3 provides a side, schematic view of certain components of the example ice making appliance of FIG. 1.

FIG. 3 provides a schematic view of certain components of ice making appliance 100. As may be seen in FIG. 3, ice maker 120 may include an ice mold 124 and a nozzle 126. For instance, ice mold 124 may include a plurality of ice molds for forming a plurality of ice cubes at one time. Liquid from nozzle 126 may be dispensed toward ice mold 124. For example, nozzle 126 may be provided below ice mold 124 within a first reservoir 128 and may dispense liquid water upward toward ice mold 124. As discussed in greater detail below, ice mold 124 is cooled by refrigerant. Thus, the liquid water from nozzle 126 flowing across ice mold 124 may freeze on ice mold 124, e.g., in order to form clear ice cubes on ice mold 124.

To cool ice mold 124, ice making assembly 100 includes a sealed system 170. Sealed system 170 includes components for executing a known vapor compression cycle for cooling ice maker 120 and/or air. The components include a compressor 172, a condenser 174, an expansion device (not shown), and an evaporator 176 connected in series and charged with a refrigerant. As will be understood by those skilled in the art, sealed system 170 may include additional components, e.g., at least one additional evaporator, compressor, expansion device, and/or condenser. Additionally or alternatively, the placement of the components (e.g., compressor 172, condenser 174, etc.) may be adjusted according to specific embodiments. Thus, sealed system 170 is provided by way of example only. It is within the scope of the present subject matter for other configurations of a sealed system to be used as well.

Within sealed system 170, refrigerant flows into compressor 172, which operates to increase the pressure of the refrigerant. This compression of the refrigerant raises its temperature, which is lowered by passing the refrigerant through condenser 174. Within condenser 174, heat exchange with ambient air takes place so as to cool the refrigerant. A fan 178 may operate to pull air across condenser 174 so as to provide forced convection for a more rapid and efficient heat exchange between the refrigerant within condenser 174 and the ambient air.

The expansion device (e.g., a valve, capillary tube, or other restriction device) receives refrigerant from condenser 174. From the expansion device, the refrigerant enters evaporator 176. Upon exiting the expansion device and entering evaporator 176, the refrigerant drops in pressure. Due to the pressure drop and/or phase change of the refrigerant, evaporator 176 is cool, e.g., relative to ambient air and/or liquid water. Evaporator 176 is positioned at and in thermal contact with ice maker 120, e.g., at ice mold 124 of ice maker 120. Thus, ice maker 120 may be directly cooled with refrigerant at evaporator 176.

It should be understood that ice maker 120 may be an air-cooled ice maker in alternative example embodiments. Thus, e.g., cooled air from evaporator 176 may refrigerate various components of ice making appliance 100, such as ice mold 124 of ice maker 120. In such example embodiments, evaporator 176 is a type of heat exchanger which transfers heat from air passing over evaporator 176 to refrigerant flowing through evaporator 176, and fan may circulate chilled air from the evaporator 176 to ice maker 120.

In some embodiments, ice making appliance 100 may further include a meltwater conduit 162. A second reservoir 138 may collect meltwater from ice storage compartment 102. In one example, meltwater conduit 162 is connected directly to ice storage compartment 102. Accordingly, liquid within ice storage compartment 102 may flow out of ice storage compartment 102 through meltwater conduit 162. In other embodiments, liquid flowing through meltwater conduit 162 may be resupplied to first reservoir 128.

Ice making appliance 100 may also include a controller 190 that regulates or operates various components of ice making appliance 100. Controller 190 may include a memory and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 190 and various operational components of ice making appliance 100. As an example, the various operational components of ice making appliance 100 may be in communication with controller 190 via one or more signal lines or shared communication busses.

Ice making appliance 100 may include first reservoir 128. First reservoir 128 may be provided within ice storage compartment 102. For example, first reservoir 128 may be located at or near top portion 112 of interior volume 111 of ice storage compartment 102. First reservoir 128 may define a receiving space that holds liquid (e.g., water) to be formed into ice. For example, an inner volume of first reservoir 128 may be smaller than interior volume 111 of ice storage compartment 102. In some embodiments, first reservoir 128 may hold other liquids, such as cleaning solutions, for example.

Ice maker 120 may be provided within first reservoir 128. In detail, evaporator 176 and ice mold 124 may be located within first reservoir 128. In some embodiments, ice maker 120 is provided above first reservoir 128 (e.g., along the vertical direction V). First reservoir 128 may extend along the vertical direction V from a bottom end 202 to a top end 204. Ice maker 120 may be mounted at the top end 204 of the first reservoir 128. For example, evaporator 176 may be mounted to the top end 204 and ice mold 124 may be connected to evaporator 176. In some embodiments, ice mold 124 may be defined by evaporator 176. In other words, evaporator 176 is integral with ice mold 124 in such embodiments, such that the clear ice is formed directly on evaporator 176.

Ice making appliance 100 may include a first circulation system 139. First circulation system 139 may include a first pump 142, a first circulation conduit 140, and a nozzle 126. First pump 142 may be provided within first reservoir 128. First pump 142 may pump water or liquid stored in first reservoir 128. First circulation conduit 140 may be connected to first pump 142 such that the water or liquid pumped by first pump 142 is circulated through first circulation conduit 140. First circulation conduit 140 may include a series of tubes or pipes capable of guiding the water or liquid pumped by first pump 142. Nozzle 126 may be provided at a downstream end of first circulation conduit 140. Nozzle 126 may dispense the water or liquid stored in first reservoir 128 toward ice maker 120 (i.e., ice mold 124 and/or evaporator 176).

In one embodiment, nozzle 126 may be located near bottom end 202 of first reservoir 128. As such, the water or liquid may be sprayed in a generally upward direction from nozzle 126 toward ice maker 120. Accordingly, clear ice may be formed on ice maker 120 due to a constant spray of water onto ice maker 120 while ice maker is cooled by a circulation of refrigerant through sealed system 170. In some embodiments, a plurality of nozzles 126 may be provided. Each of the plurality of nozzles 126 may be connected to first pump 142 independently (e.g., each nozzle 126 having a dedicated first circulation conduit 140). Additionally or alternatively, each of the plurality of first nozzles 126 may be connected to the first pump 142 via a joint circulation conduit.

A first liquid level sensor 134, or switch, may be provided in first reservoir 128. Generally, the first liquid level sensor 134 may sense a level of liquid contained within first reservoir 128. In some embodiments, first liquid level sensor 134 is in operable communication with controller 190. For instance, first liquid level sensor 134 may communicate with the controller 190 via one or more signals. In certain embodiments, first liquid level sensor 134 includes a predetermined threshold level (e.g., to indicate the need for additional liquid to first reservoir 128). In particular, first liquid level sensor 134 may detect if or when the liquid in first reservoir 128 is below the predetermined threshold level. Optionally, first liquid level sensor 134 may be a two-position sensor. In other words, first liquid level sensor 134 may either be "on" or "off," depending on a level of liquid.

For example, when the liquid level is below the predetermined threshold level, first liquid level sensor 134 is "off," meaning it does not send a signal to first pump 142 via controller 190 to pump liquid from first reservoir 128 through first circulation conduit 140 toward first nozzle 126. For another example, when the liquid level is above the predetermined threshold, first liquid level sensor 134 is "on," meaning it sends a signal to first pump 142 via controller 190 to operate first pump 142 to pump liquid through first circulation conduit 140 toward nozzle 126. It should be understood that first liquid level sensor 134 may be any suitable sensor capable of determining a level of liquid within first reservoir 128, and the disclosure is not limited to those examples provided herein.

Figure 4:
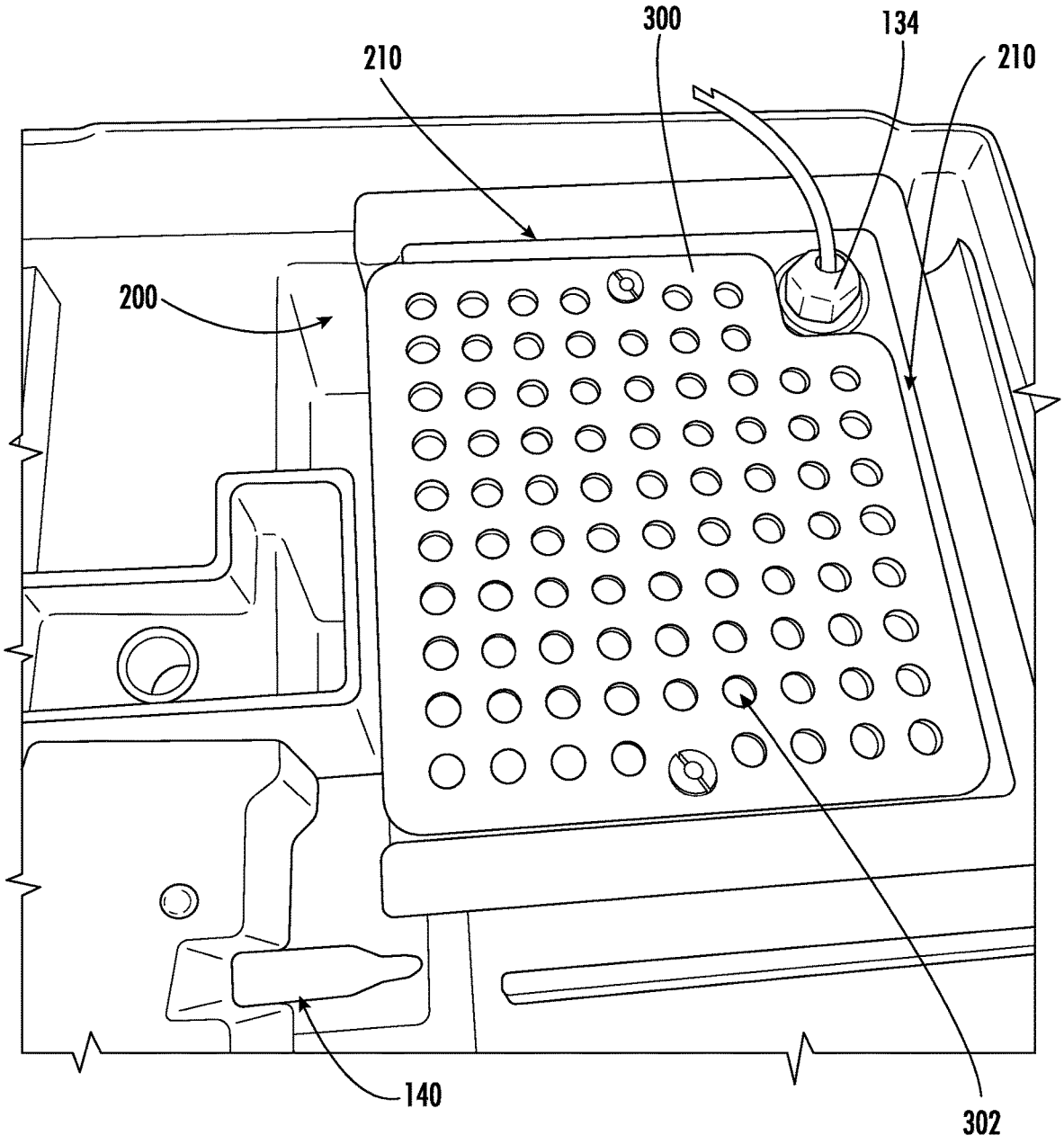
FIG. 4 provides a top, perspective view of a filter of the example ice making appliance of FIG. 1.
Figure 5:
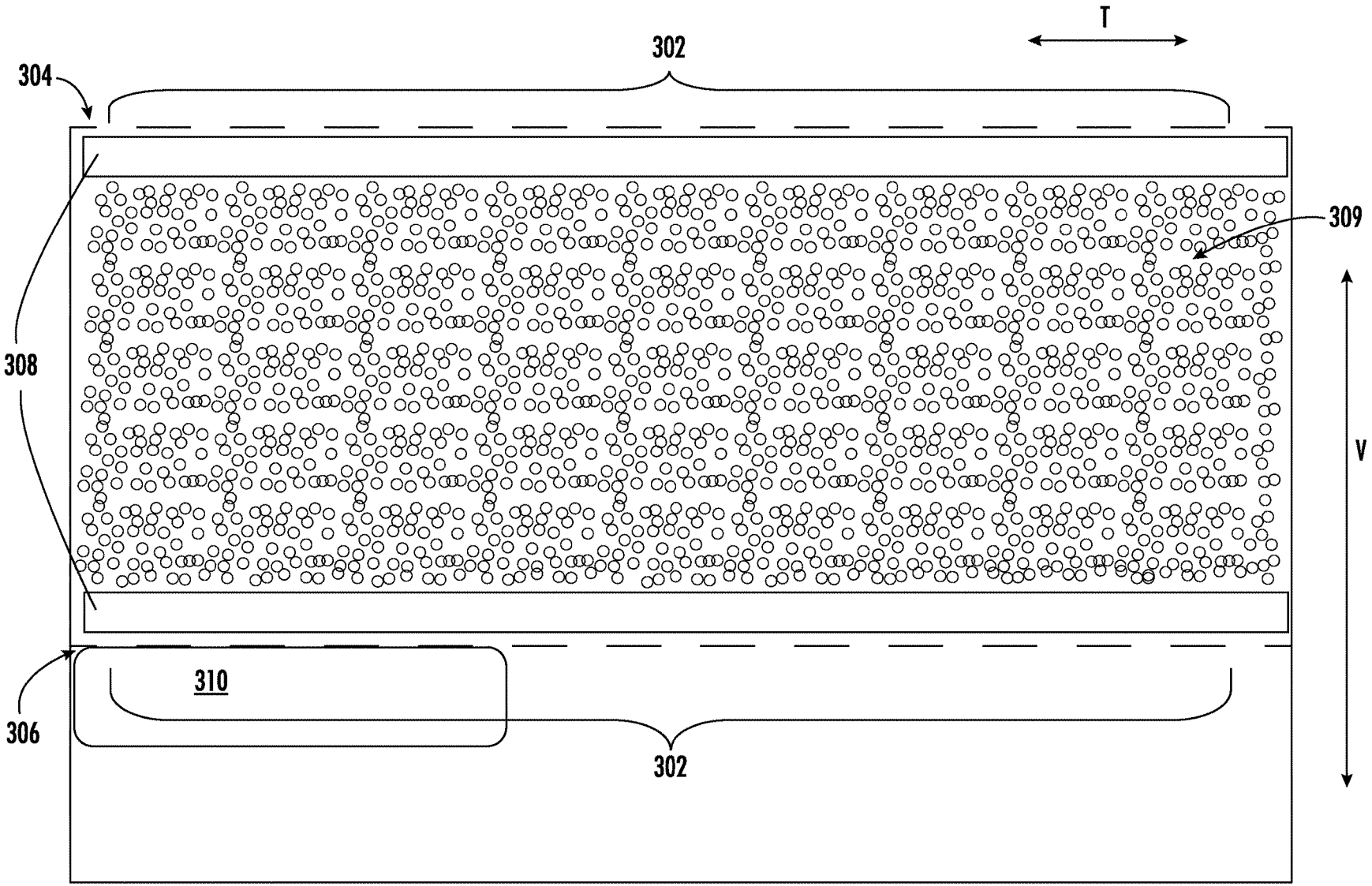
FIG. 5 provides a side, schematic view of the filter of FIG. 4 according to aspects of the present disclosure.

Referring now to FIGS. 4 and 5, in some embodiments, a gravity type filter 300 may be in fluid communication with first circulation conduit 140. Filter 300 may filter out solid contaminants from water in the first reservoir 128. In general, filter 300 may be placed inside first reservoir 128 directly below evaporator 176. The filter 300 may be provided downstream from first pump 142. Additionally or alternatively, the filter 300 may be provided upstream from nozzle 126. In some such embodiments, the filter 300 is provided along a flow path between first pump 142 and nozzle 126, such that water passes from first reservoir 128 through the filter 300 before being dispensed by nozzle 126. The filter 300 may include a filter medium which performs the actual filtration. For example, the filter 300 medium may be a deionization filter. Nonetheless, it should be understood that various additional or alternative suitable filter mediums or devices may be incorporated as the filter medium. Filter 300 will be described in further detail below.

Referring again to FIG. 3, in general, ice making appliance 100 may include a second reservoir 138. Second reservoir 138 may be provided within ice storage compartment 102. For example, second reservoir 138 may be in fluid communication with ice storage compartment 102. Second reservoir 138 may define a receiving space that holds water to be formed into ice. For example, an inner volume of second reservoir 138 may be smaller than interior volume 111 of ice storage compartment 102. As stated above, second reservoir 138 may be in fluid communication with first reservoir 128. For instance, liquid contained within first reservoir 128 may be selectively diverted to second reservoir 138. Second reservoir 138 may be lower than first reservoir 128 (e.g., along the vertical direction V). In detail, a bottom of second reservoir 138 may be lower than a bottom of first reservoir 128 along the vertical direction V. Additionally or alternatively, a top of second reservoir 138 may be lower than a top of first reservoir 128 (e.g., along the vertical direction).

Ice making appliance 100 may include a second circulation system 146. Second circulation system 146 may be provided in second reservoir 138. For instance, second circulation system 146 may include a second pump 144 and a second circulation conduit 147. A valve 132 on second circulation system 146 may receive input signals from controller 190 to selectively open and close, selectively allowing liquid from first reservoir 128 to pass through conduit 147 into second reservoir 138.

A second liquid level sensor 136 may be provided in second reservoir 138. Generally, the second liquid level sensor 136 may sense a level of liquid contained within second reservoir 138. In some embodiments, second liquid level sensor 136 is in operable communication with controller 190. For instance, second liquid level sensor 136 may communicate with the controller 190 via one or more signals. In certain embodiments, second liquid level sensor 136 includes a predetermined threshold level (e.g., to indicate the need for additional liquid to second reservoir 138). In particular, second liquid level sensor 136 may detect if or when the liquid in second reservoir 138 is below the predetermined threshold level.

A perforated ramp 104, or series of slats, may be provided above the first reservoir 128 (e.g., along the vertical direction V). Ramp 104 may be located beneath the ice maker 120 (e.g., beneath the ice mold 124 or evaporator 176). In other words, ramp 104 may be located under ice maker 120 along the vertical direction V. A top surface of the ramp 104 (or top edges of the series of slats) may be angled, e.g., angled towards the ice storage compartment 102 and/or towards an edge of the reservoir 128. In other words, a first end of ramp 104 may be positioned higher in the vertical direction V than a second end of ramp 104. Thus, when ice is formed on ice maker 120 and harvested, the ice may fall onto ramp 104 and slide towards the second end of the ramp 104, past the reservoir 128 and into ice storage compartment 102. In one example, as seen in FIG. 3, the ramp 104 is angled downward toward a front of cabinet 110. Accordingly, a passageway or hole may be provided on a side of first reservoir 128 through which the ice cubes may be ejected after sliding down ramp 104.

The ice maker 102 may further include a heater (not shown) provided at or near ice mold 124. During a harvesting of the ice cubes formed on ice mold 124, the heater may be activated to heat ice mold 124 and subsequently release the ice cubes from ice mold 124. In one embodiment, the sealed system 170 may be turned off (i.e., no refrigerant is supplied to evaporator 176) and the heater may be turned on for a predetermined amount of time. Ice mold 124 is then temporarily heated by the heater to release or harvest the ice cubes. The heater may be an electric heater, for example. However, it should be understood that various types of heaters may be used to heat ice mold 124, including a reverse flow of refrigerant or a hot gas bypass through sealed system 170, for another example, and the disclosure is not limited to those examples provided herein.

Liquid supplied to first reservoir 128 may be pumped by first pump 142 through first circulation conduit 140 to first nozzle 126, where it is selectively supplied to ice mold 124. After an ice generating operation (e.g., where the liquid is supplied to ice mold 124) is completed, the leftover liquid within first reservoir 128 may be supplied to second reservoir 138.

Referring again to FIGS. 4 and 5, as stated above, filter 300 may filter out total dissolved solids (TDS). In general, filter 300 may be seated within a slot 200 of the first reservoir 128, such that a gap 210 is defined in one or more sides of the reservoir 128. After water is sprayed onto the evaporator 176, non-frozen water may fall onto the top surface of the filter 300. Some of this water goes through the deionization filtration media and out the bottom where it returns to pump 142 and is sprayed onto the evaporator 176 again. In order to advantageously reduce pressure drop across the filter 300, a portion, or some, of the water is allowed to pass by the filter 300, e.g., water flowing through gap 210, without any TDS being removed, e.g., some water bypasses filter 300 and the TDS may not be removed, however, enough TDS is removed to make clear ice. In example embodiments, the filter 300 may be roughly rectangular shaped and may have openings 302 on a top side 304 and bottom side 306 of filter 300. Particularly, two layers 308 of porous non-woven filtration material may be placed inside filter 300 to prevent deionization resin 309, placed between the layers 308 of porous non-woven filtration material, from escaping. In example embodiments, first reservoir 128 that the filter 300 sits in, may be removeable so that filter 300 may be replaceable.

In example embodiments, a conductivity sensor 310 is coupled to the deionization filter 300. Conductivity sensor 310 may be generally configured to detect TDS in parts-per-million within first reservoir 128. In general, when the TDS stays below approximately three hundred parts-per-million (300 ppm), ice maker 120 may make clear ice. For example, conductivity sensor 310 may detect the amount of TDS in first reservoir 128 to be between one hundred parts-per-million (100 ppm) and five hundred parts-per-million (500 ppm).

Conductivity sensor 310 generally provides advantages to the consumer not previously had. For example, positioning conductivity sensor into a drainless stand-alone icemaking appliance provides important feedback to the customer, e.g., for customers using a low TDS water supply, the filter may last longer than a customer with a high TDS water supply, assuming equal ice usage. In particular, a conductivity sensor may advantageously make the customer more satisfied with the product because the stand-alone icemaking appliance may notify the costumer when the filter is actually in need of changing, not solely based on time or water usage, which solves the issue of unnecessarily replacing filters too early.

While described with regards to spraying water upwards into an ice mold to make ice, one of skill in the art would understand that aspects and advantages of the filter of the present disclosure may be used with any ice making appliance, e.g., nugget, clear, or other suitable kinds of ice making appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making appliance, comprising:

a cabinet;

an ice storage compartment;

a first reservoir provided within cabinet, the first reservoir removable from the cabinet;

an ice maker provided within the first reservoir to dispense ice into the ice storage compartment;

a circulation system arranged within the cabinet, the circulation system comprising, a first circulation conduit, a first pump connected to the first circulation conduit to pump liquid through the first circulation conduit, and a nozzle downstream from the first circulation conduit to dispense the liquid from the first circulation conduit, a second reservoir provided within the cabinet, the second reservoir being in fluid communication with the first reservoir;

a meltwater conduit connected to the ice storage compartment to direct melt water from the ice storage compartment to the second reservoir;

a second circulation conduit;

a second pump provided in the cabinet to pump meltwater through the second circulation conduit to the first reservoir;

a deionization filter provided within the first reservoir, the deionization filter comprising at least two layers, wherein the deionization filter is seated within a slot of the first reservoir, and wherein the deionization filter is a gravity type filter; and a conductivity sensor coupled to the deionization filter, wherein the conductivity sensor is positioned on the bottom side of the deionization filter within the first reservoir, and wherein a portion of the deionization filter is proximate a bottom end of the first reservoir, whereby the conductivity sensor measures total dissolved solids of liquid in the first reservoir.

2. The ice making appliance of claim 1, wherein the second reservoir is lower than the first reservoir.

3. The ice making appliance of claim 2, further comprising a valve provided between the first reservoir and the second reservoir, the valve selectively allowing liquid to flow from the first reservoir to the second reservoir.

4. The ice making appliance of claim 1, wherein a gap is defined in one or more sides of the reservoir whereby some liquid in the first reservoir passes by the deionization filter and to the first circulation conduit.

5. The ice making appliance of claim 1, wherein the deionization filter comprises openings on a top side and a bottom side of the deionization filter.

6. An ice making appliance defining a vertical direction, a lateral direction, and a transverse direction, the ice making appliance comprising:

a cabinet;

an ice storage compartment;

an ice mold provided above the ice storage compartment;

a first reservoir provided within the cabinet, the first reservoir removable from the cabinet;

a deionization filter provided within the first reservoir, the deionization filter comprising at least two layers, wherein the deionization filter is seated within a slot of the first reservoir, and wherein the deionization filter is a gravity type filter;

a conductivity sensor coupled to the deionization filter, wherein the conductivity sensor is positioned on the bottom side of the deionization filter within the first reservoir;

a first circulation system provided in the first reservoir, the first circulation system comprising an inlet downstream of the deionization filter whereby the first circulation system supplies filtered water to the ice mold; and a second reservoir provided within the cabinet, the second reservoir in fluid communication with the first reservoir, wherein a portion of the deionization filter is proximate a bottom end of the first reservoir, whereby the conductivity sensor measures total dissolved solids of liquid in the first reservoir.

7. The ice making appliance of claim 6, wherein the first circulation system comprises:

a first circulation conduit;

a first pump connected to the first circulation conduit to pump liquid from the first reservoir through the first circulation conduit; and a nozzle downstream from the first circulation conduit to dispense liquid from the first circulation conduit toward the ice mold.

8. The ice making appliance of claim 6, further comprising a second circulation system, comprising:

a second circulation conduit; and a second pump connected to the second circulation conduit to pump liquid from the second reservoir through the second circulation conduit.

9. The ice making appliance of claim 6, wherein the second reservoir is lower than the first reservoir along the vertical direction.

10. The ice making appliance of claim 9, further comprising a valve provided between the first reservoir and the second reservoir, the valve selectively allowing liquid to flow from the first reservoir to the second reservoir.

11. The ice making appliance of claim 6, wherein a gap is defined in one or more sides of the reservoir whereby some liquid in the first reservoir passes by the deionization filter and to the first circulation system.

12. The ice making appliance of claim 6, wherein the deionization filter comprises openings on a top side and a bottom side of the deionization filter.

* * * * *